US008007651B2

(12) United States Patent
Ferralli

(10) Patent No.: US 8,007,651 B2
(45) Date of Patent: Aug. 30, 2011

(54) METHOD FOR PREPARING THERMALLY TRANSMISSIVE ANODIZED SURFACE AND PRODUCTS THEREFROM

(75) Inventor: Michael W. Ferralli, Fairview, PA (US)

(73) Assignee: Transys, LLC, Erie, PA (US)

( * ) Notice: Subject to any disclaimer, the term of this patent is extended or adjusted under 35 U.S.C. 154(b) by 1090 days.

(21) Appl. No.: 11/248,989

(22) Filed: Oct. 12, 2005

(65) Prior Publication Data

US 2007/0080068 A1 Apr. 12, 2007

(51) Int. Cl.
*C25D 11/04* (2006.01)

(52) U.S. Cl. ..... 205/324; 205/202; 205/205; 205/220

(58) Field of Classification Search ..... 205/324, 205/205

See application file for complete search history.

(56) References Cited

U.S. PATENT DOCUMENTS 2,683,113 A * 7/1954 Stanley et al. ..... 205/203
3,031,387 A * 4/1962 Swanson et al. ..... 205/50
4,111,762 A * 9/1978 Wade et al. ..... 205/208
4,209,569 A * 6/1980 Brugger ..... 428/472
4,589,972 A * 5/1986 Pompea et al. ..... 205/205
5,196,106 A * 3/1993 DuPree et al. ..... 205/67
5,334,297 A * 8/1994 Nakada et al. ..... 205/118
2003/0126996 A1* 7/2003 Cheng ..... 99/422
2004/0129574 A1* 7/2004 Kia et al. ..... 205/213
2006/0257624 A1* 11/2006 Naritomi et al. ..... 428/141

FOREIGN PATENT DOCUMENTS

WO WO 2004041533 A1 * 5/2004

OTHER PUBLICATIONS

FDA Brochure, "Food Color Facts" Jan. 1993.*
Selected pages from Caswell Instruction Manual published online in 2003 and internet archive date listing showing the document originally posted on Dec. 16, 2003.*

* cited by examiner

*Primary Examiner* — Harry D Wilkins, III
*Assistant Examiner* — Bryan D. Ripa
(74) *Attorney, Agent, or Firm* — Cohen & Grigsby, P.C.

(57) ABSTRACT

A process for substantially improving the heat transmission and reflection properties of anodized metals is presented along with a method of improving such properties while allowing for such processed anodized metals to be used for food contact.

7 Claims, No Drawings

METHOD FOR PREPARING THERMALLY TRANSMISSIVE ANODIZED SURFACE AND PRODUCTS THEREFROM

FIELD OF THE INVENTION

The present invention relates to a method for improving the thermal transmissive properties of anodized surfaces and products made therefrom.

BACKGROUND OF THE INVENTION

Anodizing has been used to improve the surface properties of a number of metals, especially aluminum. The anodizing process comprises forming a substantially uniform cohesive oxide layer on the surface of the metal, and in particular aluminum. The objective of the process is to provide a uniform layer of oxide rather than a somewhat non-uniform oxide layer which naturally forms on unprotected aluminum. The anodizing process is relatively straight forward comprising the use of an electrolytic bath and placing the part to be anodized in the bath as an anode. The resulting cohesive oxide layer is substantially harder that the metal itself and can be used to protect and preserve whatever finish has been imparted to the metal, ranging from highly polished to matte. The degree of uniformity of the anodize layer is controlled by its rate of growth and the temperature of the anodize bath. The anodize surface, while reasonably uniform, is known to contain numerous pores which are typically filled in a process known as sealing. Typical sealing processes include the exposure of the oxide surface to hot water or steam to form a aluminum monohydroxide (Boehmite) or exposure to a nickel acetate solution, forming nickel hydroxide, as a sealing agent.

It is often desirable to colour the aluminum oxide layer by using a dye such as any of the commercially available "anodizing dyes" or mineral pigments prior to sealing the surface. By exposing the unsealed anodize layer to these dyes, a migration of the dye species into the oxide pores results. In some cases the dye may be introduced into the electrolytic solution used in the anodize process to dye and anodize concurrently. The subsequent sealing process locks the colour into the pores. Coloured aluminum anodizing has been used in the construction industry for many years. Coloured anodizing also has been used in the manufacture of many finished parts. For example, black anodizing in the automotive industry has been used to prevent reflection from parts used in the military such as binoculars and weapons.

It is also generally well known that the inclusion of infrared or heat absorbing dyes, such as a black dye, into the pores of the oxide layer results in a relative improvement of the heat transmission through the aluminum compared to the heat transmission through an un-dyed anodized surface or an un-anodized surface. This improvement results solely from the absorption of the dye species into the pores of the oxide layer formed by anodizing.

Present method(s) of improving the heat transmission properties of the oxide surface do not consider the effect of the abrupt surface interface created by a highly polished anodized aluminum surface. Further, present processes do not control the degree of gradient of the interfacial region, that is, the region of the interface extending from the outer most anodize-formed oxide surface to the innermost pure aluminum surface, to account for the heat energy to be reflected rather than transmitted. Finally, current processes do account for the properties of the dye used with respect to heat transmission, especially when measured against other desired properties of the dyed surface such as food toxicity, cosmetics, and environmental degradation.

Accordingly, it is an object of the present invention to provide a method for dying the anodized layer to improve the migration of heat absorption species into the pores of the oxide surface produced by anodizing and sealing that dye within the pores. It is a further object of the invention to provide a method for improving the heat transmission properties of an oxide surface of an aluminum plate while at the same time providing on its opposite side of the same plate to create an effective heat reflecting surface or mirror. It is yet another object of the invention to provide novel products using the methods of the present invention to significantly enhance transmission of thermal energy. It is another object of the invention to provide products having superior heat transmission qualities that can be used in contact with eatable products such as prepared foods and drinks.

SUMMARY OF THE INVENTION

The present invention overcomes the deficiencies of present methods for improving the heat transmission characteristics of anodized aluminum surfaces by controlling the parameters of anodize-based oxide formation to improve dye impregnation. In a preferred embodiment the improved dye impregnation is preferably achieved by "growing" an anodized oxide layer quickly at a higher current density using a higher temperature electrolytic bath or slowly at a lower current density using a lower temperature electrolytic bath. The present invention overcomes the deficiencies of current anodizing methods by creating a cross-sectional gradient layer of decreasing dye and oxide with a concurrent increasing gradient of metallic aluminum from the outermost surface of the anodized oxide layer to the surface of the metal undergoing anodization. This gradient is such that the transition from outer most surface of the oxide layer to the inner metal surface is at least ¼ of the wavelength of infrared energy, that is, from about 1 mm to 750 nm. This preferred gradient from the surface of the anodize oxide layer to the aluminum metal, the enhance heat transmission properties heat reflectivity is significant. This gradient is achieved on the surface of the metal, e.g. aluminum, by imparting a surface roughness/smoothness, rms (Root Mean Square), of at least one-quarter wavelength of the infrared spectrum, 1 mm to 750 nm during the formation of anodized layer. This is achieved by obtaining an oxide thickness with sufficient porosity for dye absorption to provide the desired gradient. The anodized coatings of the present invention are especially useful in the manufacture of novel products and, in one embodiment, products especially useful in or for the preparation of food and similar eatable items. In a presently preferred embodiment of the invention novel ice trays and cooking pans are disclosed. To achieve these objectives novel dyes are used with the method of the present invention.

Other advantages of the invention will become apparent from a perusal of the following detailed description of presently preferred embodiments of the invention.

PRESENTLY PREFERRED EMBODIMENTS OF THE INVENTION

In a presently preferred embodiment an aluminum sheet is anodized and dyed as described in example 1 of a preferred embodiment of the present invention. The surface of the aluminum was finished so that the overall surface roughness minimum was approximately ¼ of the wavelength of the longest wavelength of the heat radiation (infrared radiation) which is to be transmitted into the aluminum. The preferred roughness of this surface prior to anodizing is greater than 30 microns. The surface of the aluminum anodized with an oxide layer having a thickness of approximately 5 to 120 microns. In addition the pores of the oxide layer are filled with suitable thermally absorbing dye and sealed using conventional means known in the state of the art such using hot water or steam, or by using other agents such as nickel acetate.

In is the case where the invention is to be used for process involving food or other ingested products which contact the anodized surface, the dye use during the anodizing process should be selected from those dyes having FDA approval for use with food. The use of such approved dyes is an important aspect of the invention described herein. It is also understood that the surface treatment as described in the process of the invention can be incorporated into all anodized surfaces wherein effective heat transmission is to be imparted. Additionally the surface of the metal can transmit heat energy into the aluminum material treated on at least two sides may be used as an effective heat conduit from one material to another. For example, in transfer tubes typically located in a heat exchanger transfer heat from one fluid through the heat exchanger tubes to another fluid. In such cases the transfer is significantly enhanced; for example, up to 30%.

It has been found that oxide layer formed during anodizing in accordance with the invention consist essentially of aluminum metal bounded by regions typified by having a relatively higher number density than regions further from the metal being oxidized. Thus, the invention comprises a family of planar cross-sections through the surface which are characterized by an increasing number density of regions from the outermost surface to a gradient of thermal transmission properties characterized by the special average of the properties of any particular cross section. This thermal gradient is thus specifically prepared as a corresponding variation in thermal properties from whatever material is placed in contact with at its outermost surface of the anodized material. By virtue of this gradient rather than an abrupt change in transition substantial increases in the transfer of heat is achieved.

In this embodiment one side of metal is highly polished and the other is anodized in accordance with the invention, heat is effectively transferred to aluminum metal by thermal transmission from the outermost treated surface and the reflection of the transferred heat by the polished surface. It should be noted that this highly polished surface appears to be equally polished to the heat transmitted from the anodized surface to heat external to it. Thus, the reflected heat will be effectively transferred through the anodized surface and radiated therefrom. This embodiment of the invention can be operated as a heat reflecting mirror. An example of the use of such a device is in the reflectors incorporated into toaster or reflective space heaters wherein heat produced from the thermal source therein is to be redirected.

In all of the above embodiments, the surface finishing process may be any of those used in the state of the art that are known to produce a surface finish that is capable of being anodized. These processes include chemical or physical etching, sanding or abrasive finishing, mechanical or chemical or other polishing methods, or direct finishing through metal forming or manufacture. The metals useful in the invention include aluminum and all of its alloys which can be anodized.

In all of the above embodiments the anodizing process utilized may be any of those used in the state of the art known to produce an oxide surface whose thickness and porosity are such to allow dyeing and formation of the gradient whose dimensions have been described above.

In all of the above embodiments, the dye and dyeing process may be any of those which are known to allow transmission of heat (notably dyes which appear black, blue or other colors indicative of absorption of infrared, or those dyes known to absorb or transmit infrared). In addition are included those color producing species and pigments which may be incorporated into the anode-formed surface during the anodize process.

In all of the above embodiments, the sealing process utilized may be any of those used in the state of the art known to produce a sealed oxide surface capable of reasonably retaining the dye utilized. Other advantages of the methods of the present invention and the products produced thereby will become method.

EXAMPLES OF PRESENTLY PREFERRED EMBODIMENTS

In a preferred embodiment a ⅛ inch thick sheet of type 6061 aluminum was polished to mirror finish with a surface roughness of less than 0.1 microns. After cleaning it was etched in a caustic solution for approximately 5 minutes, generating a matte finish. The sheet was then anodized using standard procedures in a solution of 18% by weight sulfuric acid at a current density of 4 amps per square foot until such time as 720 amp-minute per square foot was delivered to the sheet. The sheet was then rinsed with water and the anodized finish was dyed in a solution consisting of 0.125% dye and 99.875% water. The dye utilized consisted of 67% by number of atoms of Erioglaucine ($C_{37}H_{34}N_2O_9Na_2S_3$) and 33% by number of atoms of Allura Red AC ($C_{18}H_{14}N_2O_8S_2Na_2$). The dye process consisted of heating the dye solution to a temperature of approximately 185 degrees F. and immersing the aluminum sheet for 20 minutes while agitating the solution. The sheet was then rived with water and the anodized finish was sealed by placing the sheet in boiling water for 30 minutes. When the sheet was tested for heat transmission, it was found to absorb heat at a rate approximately 30% faster than the same un-dyed aluminum sheet that was similarly anodized and sealed. It is note that this particular dye mixture, consisting of FD&C approved colors for food contact, when used in conjunction with the anodize process and sealing process, produces, at least in part, a material known in the art as an "aluminum lake." However, in this application they aluminum lake is fused as a cohesive structure to the aluminum metal rather than as the lake's conventional form as a powdered aluminum compound used as a pigment. In as much as such lake's have received FD&C approval for food contact, all of the aluminum surfaces thus treated can be subjected to contact with food.

In another preferred embodiment a ⅛ inch thick sheet of type 6061 aluminum was polished to mirror finish with a surface roughness of less than 0.1 microns. After cleaning, one side of the sheet was etched in a caustic solution for approximately 5 minutes, creating a matte finish. The other side retained its mirror finish. The sheet was then anodized using standard procedures in a solution of 18% by weight sulfuric acid at a current density of 4 amps per square foot until such time as 720 amp-minute per square foot was delivered to the sheet. The sheet was then rinsed with water and the anodized matte finish side of the sheet was dyed in a solution consisting of 0.125% dye and 99.875% water. The dye utilized consists of 67% by number of atoms of Erioglaucine ($C_{37}H_{34}N_2O_9Na_2$) and 33% by number of atoms of Allura Red AC ($C_{18}H_{14}N_2O_8S_2Na_2S_3$). The dye process consisted of heating the dye solution to a temperature of approximately 185 degrees F. and immersing the aluminum sheet in the dye solution for 20 minutes while agitating the solution. The sheet was then rinsed with water and the anodized finish was sealed by placing the sheet in boiling water for 30 minutes. When the sheet was tested for heat reflection, it was found that the matte side absorbed heat which then was transmitted through the sheet thickness to the polished side. Noting that from the point of view of the interior of the aluminum the polished side retains its mirror finish, the heat energy is reflected, again transmitted through the sheet thickness and re-emitted from the matte side. Thus the sheet acts as a heat reflecting mirror because the mirror surface, being confined within the aluminum, is not subject to any degrading elements that would adversely effect its reflectivity. This is in sharp contrast to the vulnerability of conventional heat mirrors. It is noted that this particular dye mixture, consisting of FD&C approved colors for food contact, when used in conjunction with the anodize process and sealing process, also produces an aluminum lake.

Two identical specimens of round 6061 aluminum bar stock measuring 38 mm in diameter and 18 mm in thickness were anodized by cleaning with a solution of 10% by weight sodium hydroxide and 90% distilled water for 10 seconds, anodized in a solution of 20% by weight sulfuric acid and 80% distilled water for a period of 1 hour using a 0.5 amp anodizing current. One of the specimens was then dyed using the dye solution described above in the preferred embodiment for a period of 20 minutes at a temperature of 95 degrees Celsius. The specimens were stored for 48 hours at room temperature after which both specimens were hot water sealed by placing them in boiling water for a period of 1 hour. The specimens were dried and the tops of both were coated with black lacquer in order to create identical surfaces for thermal emissivity (for temperature measurement purposes). Both specimens were simultaneously placed on a hot plate with the lacquered side up having a uniform temperature of 177 degrees Celsius for a period of 5 seconds. Their temperature was simultaneously recorded after this 5 second interval using an infrared temperature sensor. The temperature of the un-dyed specimen was found to be 41 degrees Celsius while the temperature of the dyed specimen was found to be 59 degrees Celsius. Since the temperature of each specimen is proportional to the heat gained, it was found that the dye specimen provided a 43% increase in heat transfer.

A large commercial ice tray was constructed from aluminum having a grid of 140 sections also made from aluminum. The entire tray underwent the anodizing process of the present invention using the food grade dyes described above. It was found to provide significantly better ice production than conventional trays without the thermal anodizing of the present invention. The water/ice acts as a radiator of heat and the aluminum evaporator acts as either a mirror which reflects the heat back into the water/ice or allows it to be transferred into the aluminum. The water/ice molecules produce thermal radiation and lose heat both by thermal conductivity and radiation. Using Stefan's Law, 271 watts per square meter represents the amount of energy/second per square meter which actually goes into the aluminum by means of radiation. The number is calculated from Stefan's Law, taking into account the amount of heat reflected, since both the water and ice are radiating thermal energy. Further, even if the ice forms on the evaporator first that does not alter the radiation component of heat transfer. However, it does alter the thermal conductivity component.

Attempts to make ice cubes in an evaporator tray having its metal surfaces polished to a mirror finish (in the thermal energy range) all radiated heat would be reflected back into the ice and the only thermal energy that would be transferred would be that by means of conduction. Using only the thermal conductivity, the water freezes slower since the energy must be passed from molecule to molecule.

The data were generated using Stefan's law and the emissivity (actually absorbance since the heat is passing from the water/ice into the aluminum) of the aluminum evaporator. Using identical samples, uncoated aluminum and aluminum anodized with food grade dye, in air under identical conditions it was found that the anodized aluminum absorbs heat approximately 30% faster than uncoated aluminum. The comparative nature of the experiment eliminated the convective and conductive thermal transfer differences since they were identical. Absolute values were not used since they would depend upon the entire experimental configuration.

Similar experiments were conducted using an aluminum frying pan having both the interior as well as the exterior anodized in accordance with the examples of the present invention.

While the present invention has been described in particularity, it may otherwise be embodied with in the scope of the appended claims.

What is claimed is:

1. A method for preparing thermally transmissive anodizeable aluminum and aluminum alloy surfaces for receiving selected infrared radiation thereon, comprising (a) selecting a range of infrared thermal radiation;

(b) providing a roughness gradient of at least ¼ wavelength of said selected range of infrared radiation on said surface;

(c) anodizing said surface gradient to provide a porous oxide layer having thickness of from about 5μ to about 120μ; and (d) applying a thermally adsorptive dye to said porous oxide layer; and sealing said dyed oxide layer.

2. A process as set forth in claim 1 wherein said prepared surface has a surface roughness of at least 30μ.

3. A process as set forth in claim 2 wherein said anodizing is carried out in a dilute solution of sulfuric acid at about 4 amps/ft$^2$ until approximately 720 amp-min/ft$^2$ is delivered to the aluminum surface.

4. A process as set forth in claim 1 wherein said thermal dyes are selected from those dyes which have FD&C approval.

5. A process as set forth in claim 1 wherein said infrared transmissive dyes are selected from the group consisting of Erioglaucine and Allura Red AC.

6. A process as set forth in claim 1 wherein said infrared transmissive dyes are selected from those dyes which wholly or partially form aluminum lakes fused to said oxide surface.

7. A process as set forth in claim 1 wherein said aluminum surface is at least a surface that is prepared to contact eatable products during processing or cooking.

* * * * *